US008686919B1

(12) United States Patent
Sergi

(10) Patent No.: US 8,686,919 B1
(45) Date of Patent: Apr. 1, 2014

(54) APPARATUS FOR ALLOWING PIVOTAL MOVEMENT OF AN ANTENNA MAST RELATIVE TO ITS SUPPORT POST

(76) Inventor: Paul D. Sergi, Tallmadge, OH (US)

( * ) Notice: Subject to any disclaimer, the term of this patent is extended or adjusted under 35 U.S.C. 154(b) by 400 days.

(21) Appl. No.: 13/153,817

(22) Filed: Jun. 6, 2011

(51) Int. Cl.
*H01Q 1/12* (2006.01)

(52) U.S. Cl.
USPC ..... 343/890

(58) Field of Classification Search
USPC ..... 343/882, 890
See application file for complete search history.

(56) References Cited

U.S. PATENT DOCUMENTS

| | | | | |
|---|---|---|---|---|
| 5,721,558 | A | 2/1998 | Holemans | |
| 6,361,007 | B1 | 3/2002 | Oby et al. | |
| 6,982,680 | B2 | 1/2006 | Janoschka et al. | |
| 7,004,043 | B2 | 2/2006 | Erel et al. | |
| 7,015,872 | B1 | 3/2006 | Little | |
| 7,432,875 | B1 | 10/2008 | Sergi | |
| 8,130,168 | B1 * | 3/2012 | Sergi et al. | 343/882 |
| 2006/0026797 | A1 | 2/2006 | Coyle | |

OTHER PUBLICATIONS

Drawings of U.S. Appl. No. 12/587,573 (filed Oct. 13, 2009—3 sheets) entitled Apparatus for Raising and Lowering an Antenna.

* cited by examiner

*Primary Examiner* — Seung Lee
(74) *Attorney, Agent, or Firm* — Renner, Kenner, Greive, Bobak, Taylor & Weber

(57) ABSTRACT

An apparatus (10) for attaching an antenna mast (11) to a post (12) positioned in the ground includes a bracket (14) attached to the mast (11). A plate (13) is attached to the post (12). The plate has a slot (32) which receives a bolt (30) that extends through the mast (11) and the bracket (14). The plate also has an elongate opening (33) which receives a bolt (31) that extends through the mast (11) and the bracket (14). Nut assemblies (34) are provided for the bolts (30, 31) and when tightened, the mast (11) and the bracket (14) are attached to the plate (13) and the post (12). But when loosened, the bolt (30) may be moved in slot (32) and bolt (31) may be moved in opening (33) until the bolt (30) is out of the slot (32) at which time the mast (11) and the bracket (14) may be rotated relative to the post (12) and the plate (13).

18 Claims, 3 Drawing Sheets

APPARATUS FOR ALLOWING PIVOTAL MOVEMENT OF AN ANTENNA MAST RELATIVE TO ITS SUPPORT POST

TECHNICAL FIELD

This invention relates to an apparatus which attaches an antenna mast to a support post. More particularly, this invention relates to such an apparatus which can selectively allow the antenna to be pivoted downwardly to permit work to be done on the antenna.

BACKGROUND ART

In vertical antennas, the antenna mast is usually mounted to a support post or stake which is positioned in the ground. When it becomes necessary to repair a damaged antenna, or if an adjustment of the tuning of the antenna must be made, the user is typically required to climb a ladder or employ some other type of elevating device, and then while positioned well above the ground, the user can attempt to perform the necessary tasks. Such is a tedious and potentially dangerous operation. Alternatively, the mast could be disassembled from the post, and then the mast could be carefully lowered so that the desired tasks could be performed while the antenna is on the ground. Thereafter, the user would be required to perform the tedious task of raising the antenna and holding it in position while reattaching the mast to the support post.

In response to these problems, devices have been created which attach the mast to the post, but with some manipulation, the mast can be rotated relative to the post and brought to the ground. However, in some of these devices, the mast must be totally disconnected from the post, while being held by the user, creating the possibility that it could be dropped.

The need exists, therefore, for a simple, efficient and safe system of mounting an antenna mast to a support post so that work can be performed on an antenna without the need to elevate oneself above the ground or the need to disassemble the antenna mast from the post.

DISCLOSURE OF THE INVENTION

It is thus an object of one aspect of the present invention to provide a device which easily allows pivotal movement of an antenna relative to its support post.

It is an object of another aspect of the present invention to provide such an apparatus, as above, which is economically manufactured and safe to use.

These and other objects of the present invention, as well as the advantages thereof over existing prior art forms, which will become apparent from the description to follow, are accomplished by the improvements hereinafter described and claimed.

In general, an apparatus of the present invention which attaches the mast of an antenna to a post includes a bracket adapted to be attached to the mast and a plate adapted to be attached to the post. A slot extends through the top of the plate and an elongate opening is formed in the plate, the opening being longer than the slot. A first bolt extends through the bracket and the slot, and a second bolt is spaced from the first bolt and extends through the bracket and the opening.

The present invention also contemplates the combination of an antenna mast, a support post, and a device attaching the mast to the post. The device includes a bracket attached to the mast, a plate attached to the post, a slot extending through the top of the plate, and an elongate opening in the plate which is longer than the slot. A first bolt extends through the bracket and the slot and a second bolt extends through the bracket and the opening.

A preferred exemplary apparatus for pivotally connecting an antenna mast to a support post is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
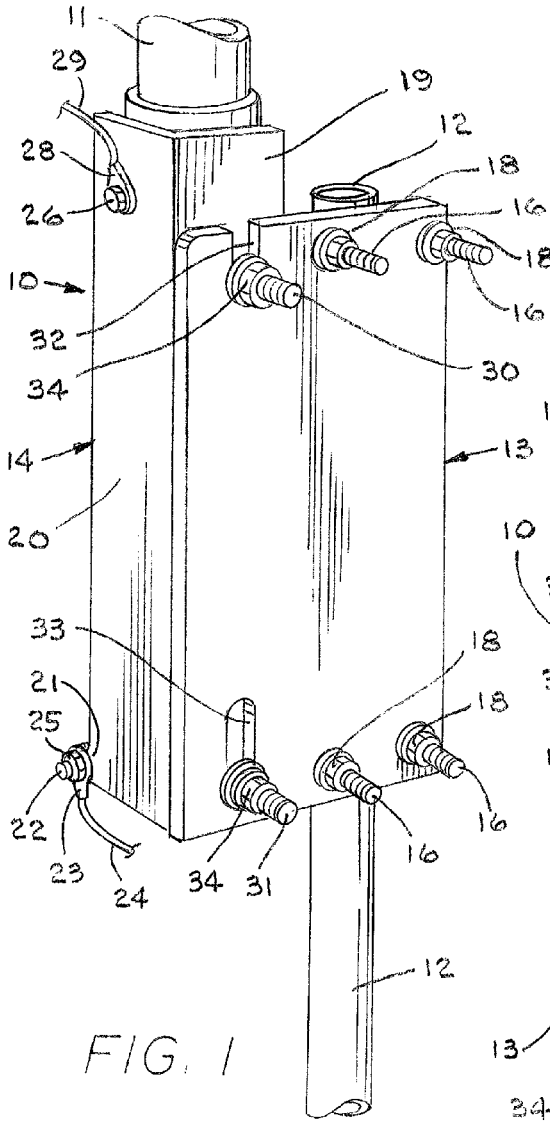
FIG. 1 is a front perspective view showing the apparatus of the present invention in a position wherein the antenna mast is attached to a support post and is being vertically maintained.

The present invention relates to an apparatus, generally indicated by the numeral 10, for attaching the mast 11 of an antenna to a support post 12 mounted in the ground, while at the same time permitting the mast 11 to be tilted relative to the post 12. Apparatus 10 includes a plate generally indicated by the numeral 13 and attached to post 12, and an angle bracket generally indicated by the numeral 14 and attached to mast 11.

Figure 4:
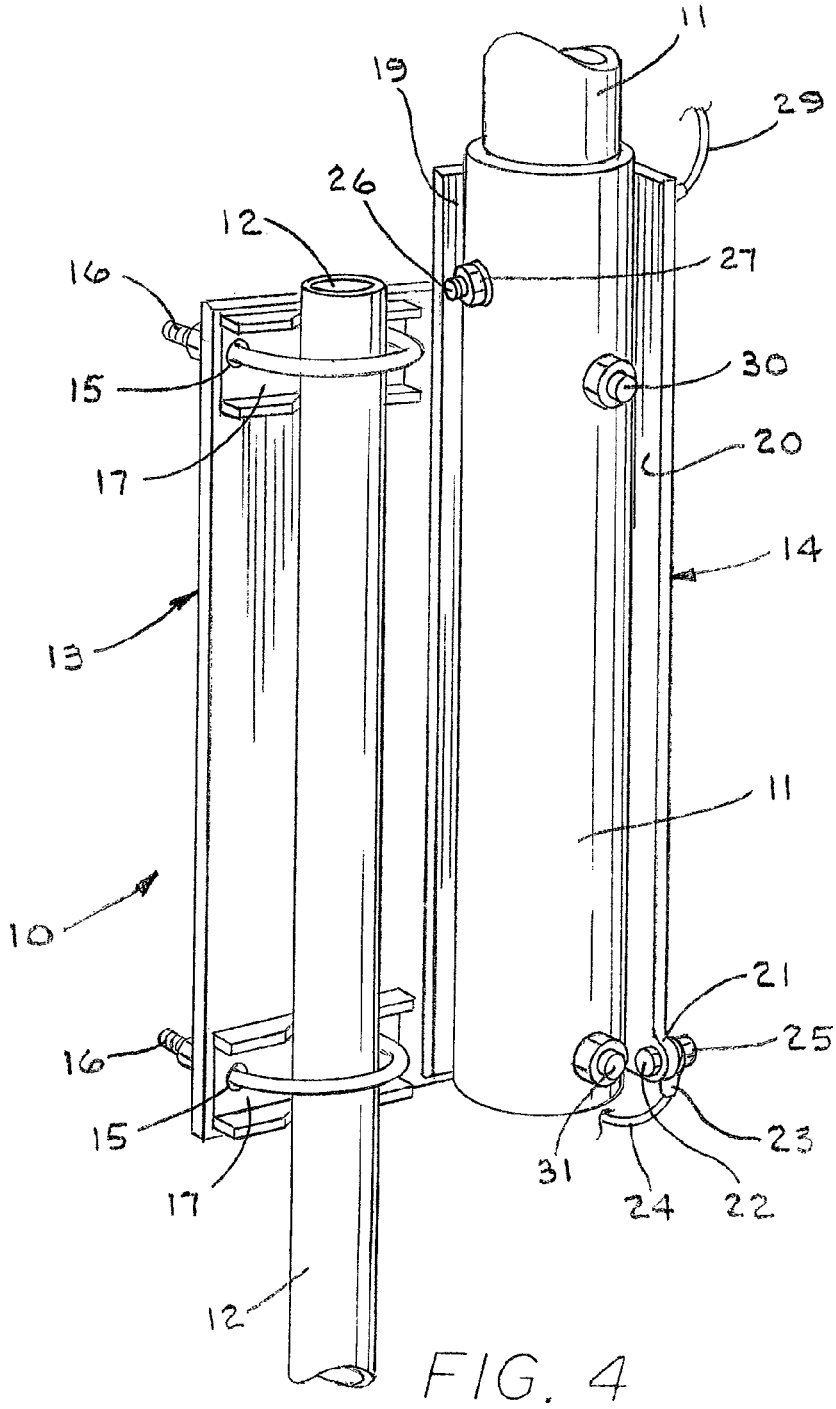
FIG. 4 is a perspective view of the apparatus of FIG. 1.

As best seen in FIG. 4, plate 13 is provided with spaced apertures 15 near the top and bottom thereof which receive the U-bolts 16 of conventional saddle clamps 17 which attach plate 13 to post 12. Washer and nut assemblies 18 are received on U-bolts 16 so that post 12 is firmly engaged.

Angle bracket includes a first face 19 which is adapted to rest against plate 13, and a second face 20 which extends from first face 19 at generally a ninety degree angle. The bottom, outer surface of second face 20 is provided with an eyelet 21 through which a bolt 22 may be received. A connector 23 of a ground wire 24 is received around bolt 22 and affixed thereto by nut 25. Ground wire 24 can extend to another component of the antenna, such as the radial plate shown in U.S. Pat. No. 6,927,740. A bolt 26 extends through second face 20 and through mast 11 to receive a nut 27 which serves to hold second face 20 against mast 11. A connector 28 of a ground wire 29 may also be received around bolt 26 and may extend to another antenna component such as a balun.

Bracket 14 is further attached to mast 11 by an upper bolt 30 and a lower bolt 31 which extend through mast 11 and through the first face 19 of bracket 14. Thus, mast 11 is securely held to bracket 14 by bolts 26, 30 and 31. Bolts 30 and 31 can also serve to attach bracket 14, and thus mast 11, to plate 13, as now will be described.

Plate 13 is provided with a generally vertical slot 32 which is open through the top surface of plate 13. Plate 13 is also provided with an elongate, vertically extending opening 33 near the bottom thereof. Opening 33 is aligned with slot 32 and receives the lower bolt 31 therethrough. Slot 32 receives the upper bolt 30 therethrough. The bottom of slot 32 and the bottom of opening 33 are spaced by the same distance as upper and lower bolts 30, 31 are spaced so that when nut assemblies 34 are tightened on bolts 30 and 31, bracket 14 and mast 11 will be attached to plate 13 with bolt 30 being at the bottom of slot 32 and bolt 31 being at the bottom of opening 33. Such is shown in FIG. 1.

Figure 2:
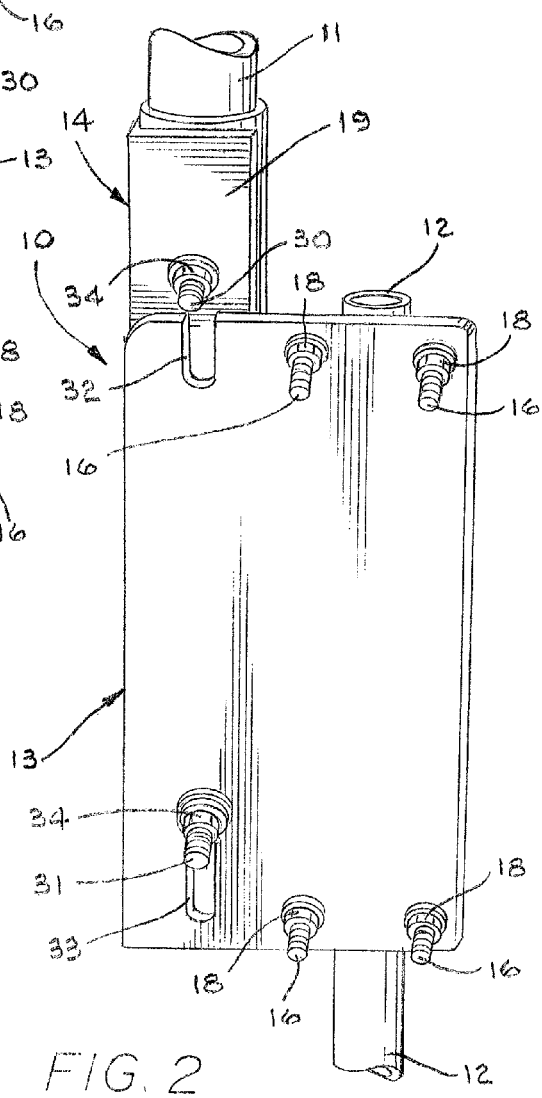
FIG. 2 is a perspective view of the apparatus sequentially following FIG. 1 when it is desired to rotate the mast relative to the support post.
Figure 3:
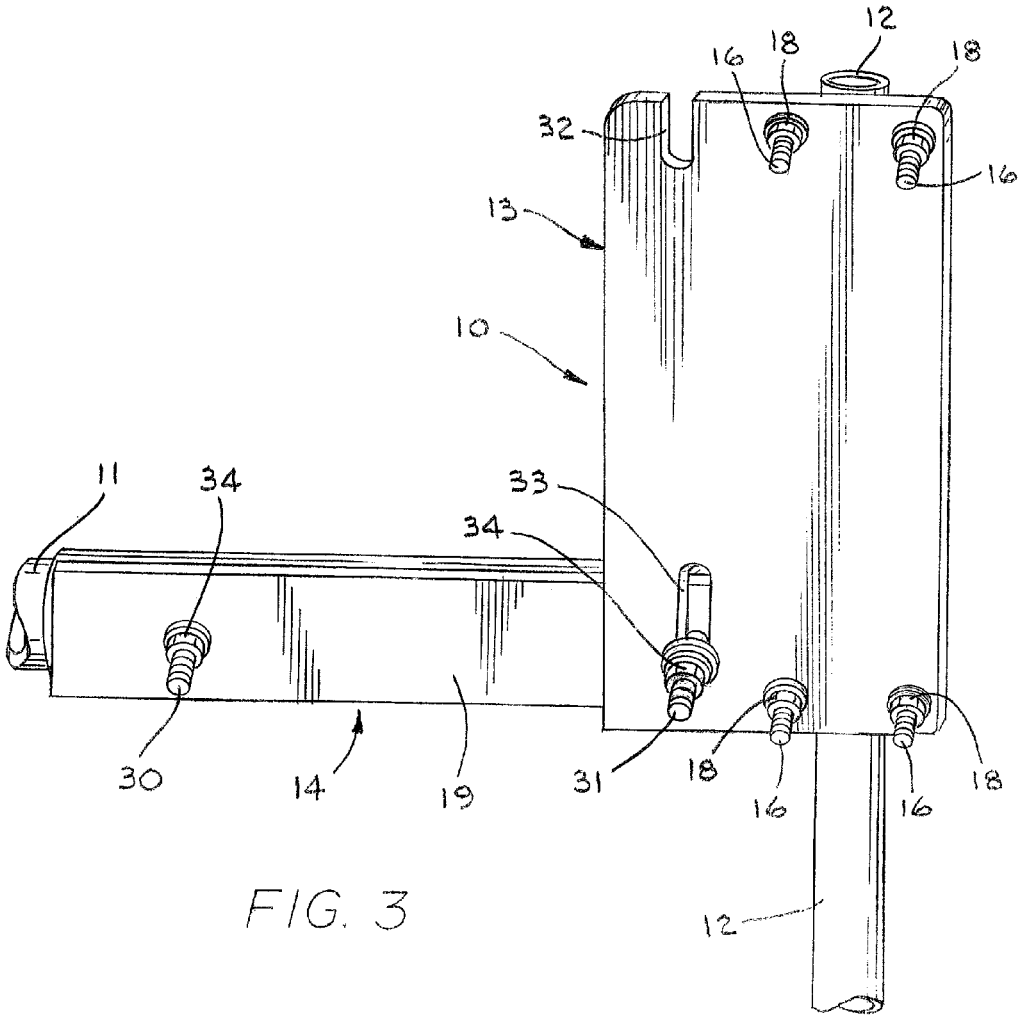
FIG. 3 is a perspective view sequentially following FIG. 2 and showing the mast fully rotated relative to the support post.

If maintenance or some kind of adjustment is required on the antenna, which is carried at the top of mast 11, apparatus 10 can easily and conveniently permit the lowering of the antenna to the ground. To that end, bolts 30 and 31 need not be removed. Rather, by merely loosening nut assemblies 34, mast 11 and bracket 13 can be lifted until bolt 31 engages the top of opening 33. Because opening 33 is longer than slot 32, at this time bolt 30 is out of slot 32 as shown in FIG. 2. As such, mast 11 and bracket 13 may be rotated on a pivot point defined by bolt 31 from the FIG. 2 position downward to, for example, the FIG. 3 position where work may conveniently be done on the antenna. As shown in the FIG. 3, in this position bolt 31 is at the bottom of opening 33 because the user is no longer holding mast 11. When maintenance or other activity on the antenna is completed, these steps may be reversed, and nut assemblies 34 tightened to securely position the antenna in the FIG. 1 operating position.

In view of the foregoing, it should be evident that an apparatus constructed and operated as described herein accomplishes the objects of the invention and otherwise substantially improves the antenna art.

What is claimed is:

1. Apparatus to attach the mast of an antenna to a post comprising a bracket adapted to be attached to the mast, a plate adapted to be attached to the post, a single bolt-receiving slot extending through the top of said plate, a single bolt-receiving opening in said plate having only a generally vertical component, a first bolt extending through said bracket and said slot, and a second bolt spaced from said first bolt and extending through said bracket and said opening, said opening being longer than said slot so that when said second bolt is moved upwardly to the top of said opening, said first bolt moves out of said slot such that when said second bolt returns to the bottom of said slot, said bracket is fully rotatable on said second bolt.

2. The apparatus of claim 1 wherein said opening is vertically aligned with said slot.

3. The apparatus of claim 1 wherein the bottom of said slot and the bottom of said opening are spaced the same distance as the spacing between said first and second bolts.

4. The apparatus of claim 1 further comprising nut assemblies fastened on each of said bolts to attach said bracket to said plate, said nut assemblies being capable of being loosened to allow movement of said first bolt in said slot and movement of said second bolt in said opening.

5. The apparatus of claim 1 further comprising U-bolts, said plate having apertures therethrough to receive said U-bolts, said U-bolts being adapted to attach the post to said plate.

6. The apparatus of claim 1 wherein said bracket includes a first face and a second face angularly connected to said first face.

7. The apparatus of claim 6, said first and second bolts extending through said first face thereby positioning said first face adjacent to said plate.

8. Apparatus to attach the mast of an antenna to a post comprising a bracket adapted to be attached to the mast, a plate adapted to be attached to the post, a slot extending through the top of said plate, an elongate opening in said plate, said opening being longer than said slot, a first bolt extending through said bracket and said slot, a second bolt spaced from said first bolt and extending through said bracket and said opening, said bracket including a first face and a second face angularly connected to said first face, said first and second bolts extending through said first face thereby positioning said first face adjacent to said plate, and an eyelet extending from said second face, said eyelet being adapted to receive a wire for connection to another antenna component.

9. Apparatus to attach the mast of an antenna to a post comprising a bracket adapted to be attached to the mast, a plate adapted to be attached to the post, a slot extending through the top of said plate, an elongate opening in said plate, said opening being longer than said slot, a first bolt extending through said bracket and said slot, a second bolt spaced from said first bolt and extending through said bracket and said opening, said bracket including a first face and a second face angularly connected to said first face, said first and second bolts extending through said first face thereby positioning said first face adjacent to said plate, and a bolt extending through said second face and the mast, said bolt being adapted to hold a wire for connection to another antenna component.

10. In combination, an antenna mast, a support post, and a device for attaching the mast to the post, the device including a bracket attached to the mast, a plate attached to the post, a single bolt-receiving slot extending through the top of the plate, a single bolt-receiving opening in the plate having only a generally vertical component, a first bolt extending through the bracket the slot, and a second bolt extending through the bracket and the opening, the opening being longer than the slot so that when the second bolt is moved upwardly to the top of the opening, the first bolt moves out of the slot such that when the second bolt returns to the bottom of the slot, the bracket can be fully rotatable on the second bolt.

11. The combination of claim 10 wherein the opening is vertically aligned with the slot.

12. The combination of claim 10 wherein the bottom of the slot and the bottom of the opening are spaced the same distance as the spacing between the first and second bolts.

13. The combination of claim 10, the device further including nut assemblies fastened on each of the bolts to attach the bracket to the plate, the nut assemblies being capable of being loosened to allow movement of the first bolt in the slot and movement of the second bolt in the opening.

14. The combination of claim 10, the device further including apertures in the plate, and U-bolts engaging the post and extending through the apertures to attach the post to the plate.

15. The combination of claim 10 wherein the bracket includes a first face and a second face angularly connected to the first face.

16. The combination of claim 15, said first and second bolts extending through the first face thereby positioning the first face adjacent to the plate.

17. The combination of claim 16, the device further including an eyelet extending from the second face, the eyelet being adapted to receive a wire for connection to another antenna component.

18. The combination of claim 16, the device further including an eyelet extending from the second face, the eyelet being adapted to receive a wire for connection to another antenna component.

* * * * *